US006129134A

United States Patent [19]

Divecha

[11] Patent Number: 6,129,134

[45] Date of Patent: Oct. 10, 2000

[54] SYNTHESIS OF METAL MATRIX COMPOSITE

[75] Inventor: Amarnath P. Divecha, Falls Church, Va.

[73] Assignee: The United States of America as represented by the Secretary of the Navy, Washington, D.C.

[21] Appl. No.: 09/266,266

[22] Filed: Mar. 11, 1999

[51] Int. Cl.[7] ..... B22D 19/14; B22D 27/00

[52] U.S. Cl. ..... 164/97; 164/66.1; 164/68.1

[58] Field of Search ..... 164/97, 98, 66.1, 164/68.1

[56] References Cited

U.S. PATENT DOCUMENTS

| | | | |
|---|---|---|---|
| 3,941,903 | 3/1976 | Tucker | 427/190 |
| 4,946,647 | 8/1990 | Rohatgi et al. | 420/528 |
| 5,025,849 | 6/1991 | Karmarkar et al. | 164/97 |
| 5,402,843 | 4/1995 | Skibo | 164/97 |
| 5,609,286 | 3/1997 | Anthon | 228/56.3 |
| 5,658,194 | 8/1997 | Micheletti | 451/541 |

FOREIGN PATENT DOCUMENTS

| | | |
|---|---|---|
| 3-5063 | 1/1991 | Japan . |
| 2275008 | of 0000 | United Kingdom . |

*Primary Examiner*—Harold Pyon
*Assistant Examiner*—I.-H. Lin
*Attorney, Agent, or Firm*—John Forrest; Jacob Shuster

[57] ABSTRACT

Reinforcing particles within a flux are dispersed through a metal matrix deposited into a crucible purged of air by infeed of argon gas during heating of the matrix to a melted state for completing particle dispersion by agitation before remelting thereof after solidification. The remelted matrix with the particles fully dispersed therein is then allowed to undergo sedimentation increasing particle concentration along a flat surface portion of the final product having increased wear resistance thereat.

4 Claims, 1 Drawing Sheet

SYNTHESIS OF METAL MATRIX COMPOSITE

The present invention relates in general to synthesizing a metallic matrix composite having reinforcing particles therein.

BACKGROUND OF THE INVENTION

The synthesis of composite materials, such as a metal matrix with a reinforcing particles therein, by centrifugal casting is already known, as disclosed for example in U.S. Pat. No. 5,025,849 to Karmarkar et al. The centrifugal casting process is effective to provide improved wear resistance, which is however limited to symmetrical formations of the composite product due to the centrifugal force associated with the casting process. It is therefore an important object of the present invention to provide a process for synthesizing a composite product from a metal matrix with reinforcing particles therein, so as to improve wear resistance with respect to a nonsymmetrical portion of the product such as a flat surface thereon.

SUMMARY OF THE INVENTION

In accordance with the present invention, a metal matrix composite, such as an ingot of a metal alloy reinforced with carbide reinforcing particles is synthesized without centrifugal casting. Initially, the carbide particles are dispersed within the metal matrix while undergoing inductive heating to a molten state. After the melt undergoes agitation to optimize dispersion of the carbide particles, it is allowed to be cooled to room temperature until solidified. The crucible within which initial heating and agitation occurs is purged of air by infeed of argon gas prior to introduction and dispersion of the particles, and during subsequent remelting of the metal matrix with the particles dispersed therein following solidification. When remelted, the mixture of metal matrix and particles is allowed to undergo sedimentation by settling of the carbide particles so as to form a noticeably higher particulate concentration within the composite to increase wear resistance along a flat surface portion thereof.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
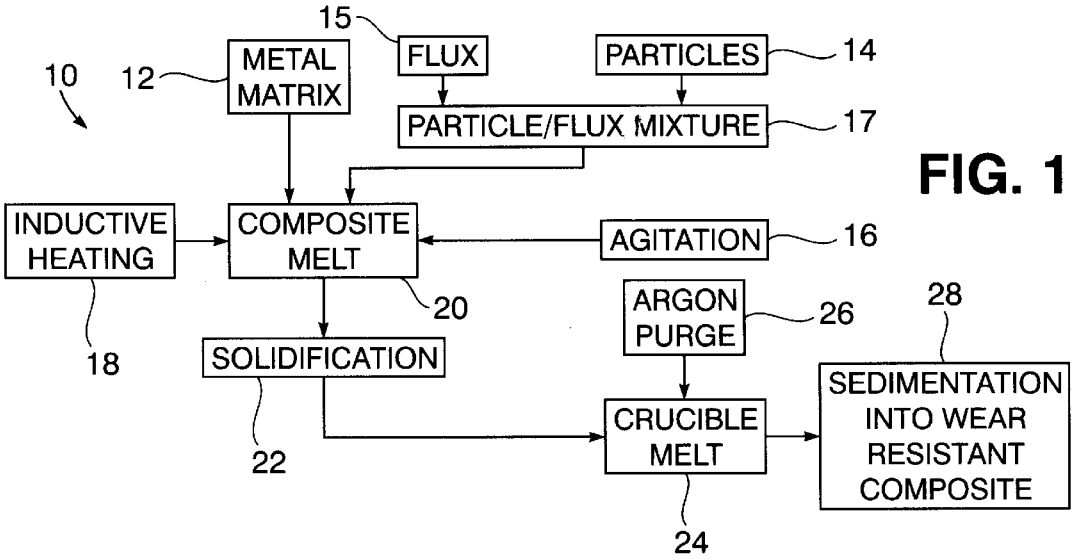
FIG. 1 is a block diagram depicting the composite synthesis process of the present invention.

Referring now to the drawing in detail, FIG. 1 diagrams a process generally referred to by reference numeral 10 for synthesizing a metal matrix composite. The components of such composite consist of a metal matrix 12 and reinforcement particles 14 which are initially mixed with a flux 15 to form a mixture 17 combined with the metal matrix 12 subject to agitation 16 while undergoing inductive heating 18 to form a composite melt 20. The metal matrix 12 may cover different metal alloys such as aluminum and bronze, while the particles 14 may include tungsten carbide (WC), silicon carbide (SiC), titanium carbide (TiC) and alumina.

The volume fraction of such particles 14 may be varied within a concentration range from 0.05 to 0.25, within which the fluidity of the matrix is not adversely affected. In the case of a bronze melt, the carbide particles 14 are initially mixed with flux 15, most conveniently by ball mill mixing. Only 10 grains of such flux 15 is needed to cover every particle of WC of −325 mesh or TC particles having a density of 4.9 g/cc. A water solution of the flux may also be suitable for dispersion 600 gms of −325 mesh TiC particles therein. In the latter case, 10 grams of flux was dissolve in 500 mls of deionized water, heated to approximately 120° F. to accelerate dissolution by stirring the mixture before complete removal of the water by further heating to 170° F. before dispersion in the melt 20. In the case of WC/Bronze composite, the matrix undergoes inductive heating 18 to form melt 20 within which particle dispersion is optimized by agitation 16 for a short period of time, under 4 minutes, followed by solidification 22 in response to cooling of the melt to room temperature. The solidified matrix composite then undergoes remelt 24 within a crucible from which air was purged by argon gas injection 26 as diagrammed in FIG. 1. Following crucible remelt 24, the metal matrix composite undergoes sedimentation 28 for a period of 2 to 30 minutes resulting in gravitationally induced settling of the heavier carbide particles dispersed within the lighter metal matrix over and along a flat surface portion thereof. A very high wear resistance is thereby achieved for the flat surface portion of the composite. In the case of a TiC/Bronze composite, the same procedure is followed to synthesize an ingot, wherein the top surface has increased wear resistance because the TiC particles of lighter density (4.99 g/cc) float while the heavier bronze matrix (7.5 g/cc) settles at the bottom. Accordingly, by use of both WC and TiC particles in a Bronze matrix, wear resistant surfaces at both top and bottom may be expected.

Figure 2:
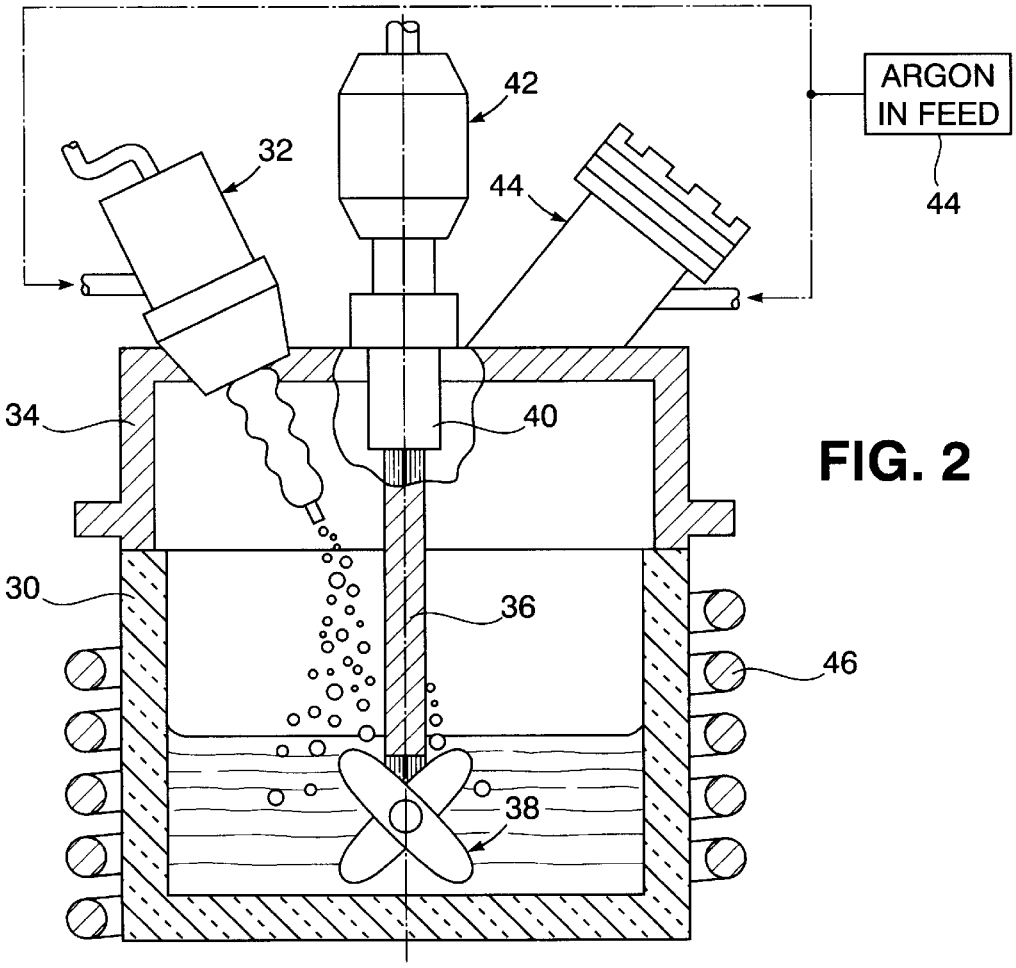
FIG. 2 is a partial section view of apparatus through which the process diagrammed in FIG. 1 may be performed.

FIG. 2 illustrates somewhat schematically the apparatus through which the process 10 diagrammed in FIG. 1 is performed. The metal matrix 12 is loaded into a crucible 30 at the bottom of the apparatus. The particles 14 intermixed with flux 15 were then introduced into the crucible 30 from a powder dispersing device 32 mounted above the crucible by a removable cover 34. Mechanical stirring of the particle and flux mixture 17 occurs within the device 32, disposed on one side and at an angle to a vertical power shaft 36 connected at its lower end adjacent the bottom of the crucible 30 to an agitator blade assembly 38. The upper end of shaft 36, extending through a bearing 40 fixed to the cover 34, is connected to an electric agitator drive motor 42. A viewing window assembly 44 is also mounted on the cover 34 on one side of the motor 42 opposite the powder dispersing device 32 through which particle dispersion within the composite melt 20 may be visually confirmed. Purging of air within the device 32 during operation thereof and in the crucible 30 is effected by pressurized argon infeed 44 connected by tubing to the device 32 and the viewing window assembly 44. The crucible 30 forms an induction heating furnace for producing the composite melt 20 and remelt 24 by energization of an electric heating coil 46 operatively mounted in encircling relation about the crucible 30. Control over various stages of the process 10 is exercised through the apparatus as hereinbefore described, involving introduction of the particle mixture 17 from device 32, inductive heating within the crucible 30 through coil 46 to form the composite melt 20 and remelt 24, energization of the motor 42 for agitation of the melt 20, and oxygen purging 26 through argon infeed 44. A metal matrix composite having a high wear resistance property along a flat surface portion thereof is thereby produced in a most rapid fashion.

Obviously, other modifications and variations of the present invention may be possible in light of the foregoing teachings. It is therefore to be understood that within the scope of the appended claims the invention may be practiced otherwise than as specifically described.

What is claimed is:

1. A method of synthesizing a composite within a crucible, comprising the steps of: heating to a molten state a mixture of a matrix and particles heavier than the matrix; agitating said mixture in the molten state for dispersion of the particles within the matrix; cooling the molten mixture until solidified; reheating the mixture when solidified until remelted; and allowing gravitationally induced settling of the particles within the matrix into a high particle concentration portion of the remelted mixture to increase wear resistance thereat, said agitating and cooling of the mixture and said reheating of the cooled solidified mixture being performed in sequence within said crucible from which air is purged.

2. The method as defined in claim 1, wherein said high particle concentration portion of the remelted mixture extends along a flat surface of the composite exhibiting said increased wear resistance.

3. The method as defined in claim 1, wherein said particles are dispersed within a flux introduced into the mixture undergoing said step of heating to the molten state to initiate the dispersion of the particles within the matrix completed by said step of agitation.

4. The method as defined in claim 1, wherein the particles are carbides and the matrix is metallic.

* * * * *